US008403467B2

(12) United States Patent
Asami

(10) Patent No.: US 8,403,467 B2
(45) Date of Patent: Mar. 26, 2013

(54) INK JET PRINTER

(75) Inventor: Keiichi Asami, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 86 days.

(21) Appl. No.: 13/052,251

(22) Filed: Mar. 21, 2011

(65) Prior Publication Data

US 2011/0234714 A1 Sep. 29, 2011

(30) Foreign Application Priority Data

Mar. 29, 2010 (JP) ..... 2010-074957

(51) Int. Cl.
*B41J 2/175* (2006.01)
*B41J 2/18* (2006.01)
*B41J 2/185* (2006.01)

(52) U.S. Cl. ..... 347/85; 347/89

(58) Field of Classification Search ..... 347/85, 347/89

See application file for complete search history.

(56) References Cited

U.S. PATENT DOCUMENTS 6,443,560 B1 9/2002 Okano et al.
6,447,084 B1 * 9/2002 Uetsuki et al. ..... 347/7
7,658,481 B2 * 2/2010 Hiratsuka et al. ..... 347/85
2002/0063759 A1 * 5/2002 Hirano et al. ..... 347/85
2006/0061638 A1 * 3/2006 Amarume et al. ..... 347/84
2007/0024682 A1 * 2/2007 Inoue ..... 347/85
2007/0291086 A1 * 12/2007 Murakami et al. ..... 347/85
2008/0158307 A1 * 7/2008 Nitta et al. ..... 347/85

FOREIGN PATENT DOCUMENTS

JP 2001-219580 A 8/2001

* cited by examiner

*Primary Examiner* — Shelby Fidler
*Assistant Examiner* — Alexander D Shenderov
(74) *Attorney, Agent, or Firm* — Holtz, Holtz, Goodman & Chick, P.C.

(57) ABSTRACT

An ink jet printer has an ink circulation unit including an image recording unit to discharge ink to perform image recording on a recording medium; a first tank disposed above the image recording unit in a gravitational force direction to supply the ink to the image recording unit through a first ink path; a second tank disposed below the image recording unit in the gravitational force direction to collect the ink that was not discharged from the image recording unit through the second ink path; a pump to send the ink from the second tank to the first tank through a third ink path, and at least a part of the first ink path connecting the first tank and the image recording unit is positioned below an ink liquid level in the second tank in the gravitational force direction.

13 Claims, 7 Drawing Sheets

INK JET PRINTER

CROSS-REFERENCE TO RELATED APPLICATIONS

This application is based upon and claims the benefit of priority from the prior Japanese Patent Application No. 2010-074957, filed in Mar. 29, 2010, the entire contents of which are incorporated herein by reference.

BACKGROUND OF THE INVENTION

1. Field of the Invention

The present invention relates to an ink jet printer having an ink circulation path for circulating ink and a manufacturing method thereof.

2. Description of the Related Art

Ink jet printers are equipped with an ink head of the thermal head type or the piezoelectric conversion element (piezo) type. The ink head discharges ink drops on a recording medium such as paper, a film and the like, to perform recording (printing). Some of such printers have an ink circulation path for circulating ink.

For example, in an inkjet printer disclosed in Japanese Laid-open Patent Publication No. 2001-219580, an ink circulation path is formed with an ink discharge unit, an ink flow volume adjustment room provided above the ink discharge unit, an ink collection container provided below the ink discharge unit, and a pump that sends ink in the ink collection container to the ink flow volume adjustment room form an ink circulation path.

Then, in the ink jet printer disclosed in Japanese Laid-open Patent Publication No. 2001-219580, ink is circulated by flowing the ink into the ink discharge unit by the difference in the vertical positions of the ink flow volume adjustment room and the ink collection container, and pumping ink collected in the ink collection container to the ink flow adjustment room by the pump.

Here, upon delivery (transportation) of an ink jet printer in such a configuration, a meniscus formed in the nozzle hole of the ink discharge unit may be destroyed by shaking or shock, and the nozzle hole may suck in some air.

When the air sucked in from the nozzle hole is trapped in the ink path connecting the ink flow volume adjustment room and the ink discharge unit, the trapped air replaces ink in the ink path. Then, ink stored in the ink flow volume adjustment room eventually runs down to the ink collection container.

Therefore, in Japanese Laid-open Patent Publication No. 2001-219580 mentioned above, an electromagnetic valve is provided in the ink path connecting the ink flow volume adjustment room and the ink discharge unit.

SUMMARY OF THE INVENTION

An embodiment according to the present invention is an ink jet printer having an ink circulation unit including an image recording unit to discharge ink to perform image recording on a recording medium; a first tank disposed above the image recording unit in a gravitational force direction to supply the ink to the image recording unit through a first ink path; a second tank disposed below the image recording unit in the gravitational force direction to collect the ink that was not discharged from the image recording unit through the second ink path; a pump to send the ink from the second tank to the first tank through a third ink path, with at least a part of the first ink path connecting the first tank and the image recording unit being positioned below an ink liquid level in the second tank in the gravitational force direction.

Advantages of the invention will be set forth in the description which follows, and in part will be obvious from the description, or may be learned by practice of the invention. Advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DESCRIPTION OF THE PREFERRED EMBODIMENTS

Figure 1A:
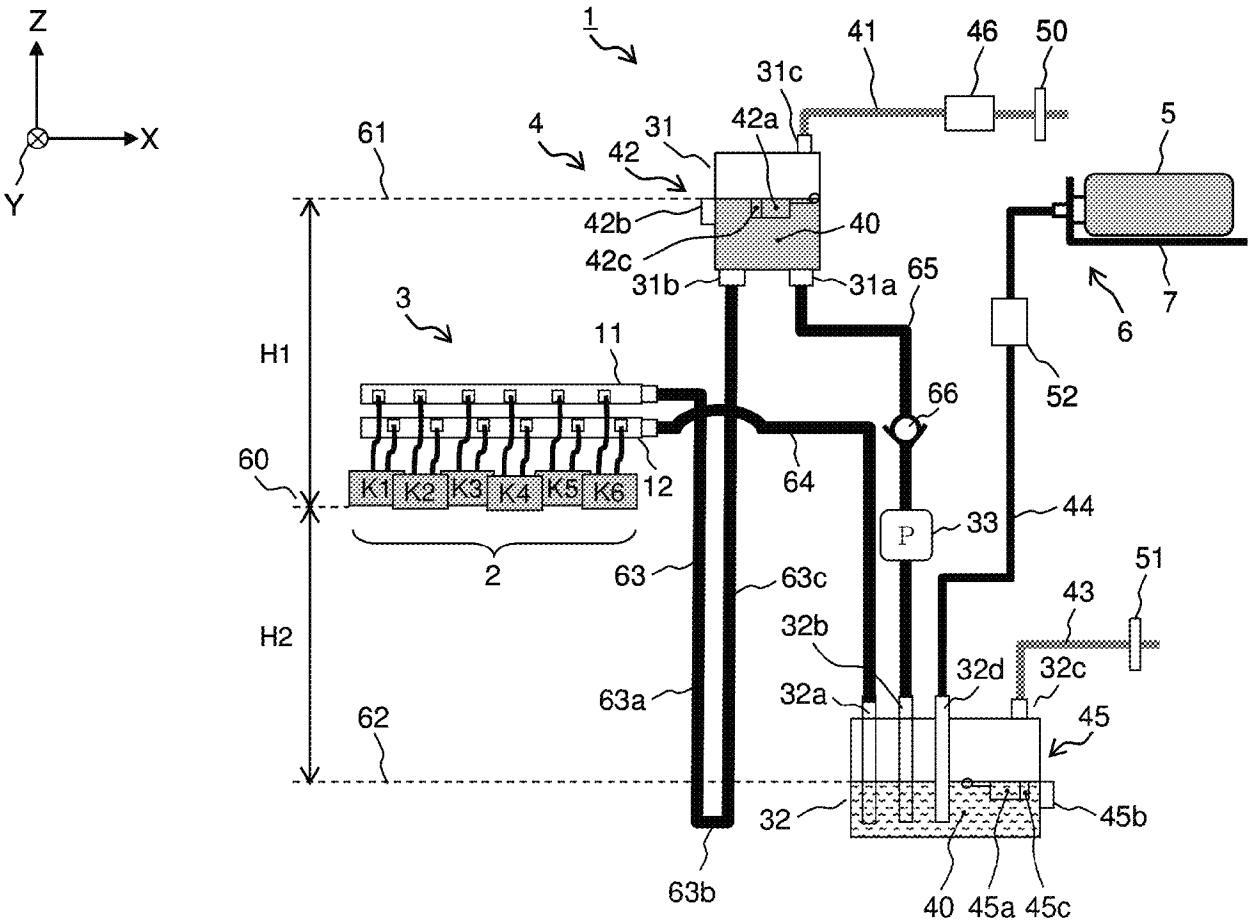
FIG. 1A is a conceptual diagram presenting a configuration example of an ink path of an ink jet printer being an embodiment of the present invention.

Hereinafter, embodiments of the present invention are described in detail with reference to drawings.

In the description of embodiments of the present invention, in each figures, the directions X, Y, Z are as indicated in the drawings, for example, it is assumed that the Z direction is the perpendicular (gravitational force) direction, and the X-Y plane is a horizontal plane.

(Embodiment 1)

FIG. 1A is a conceptual diagram presenting a configuration example of an ink path of an ink jet printer being an embodiment of the present invention.

Figure 1B:
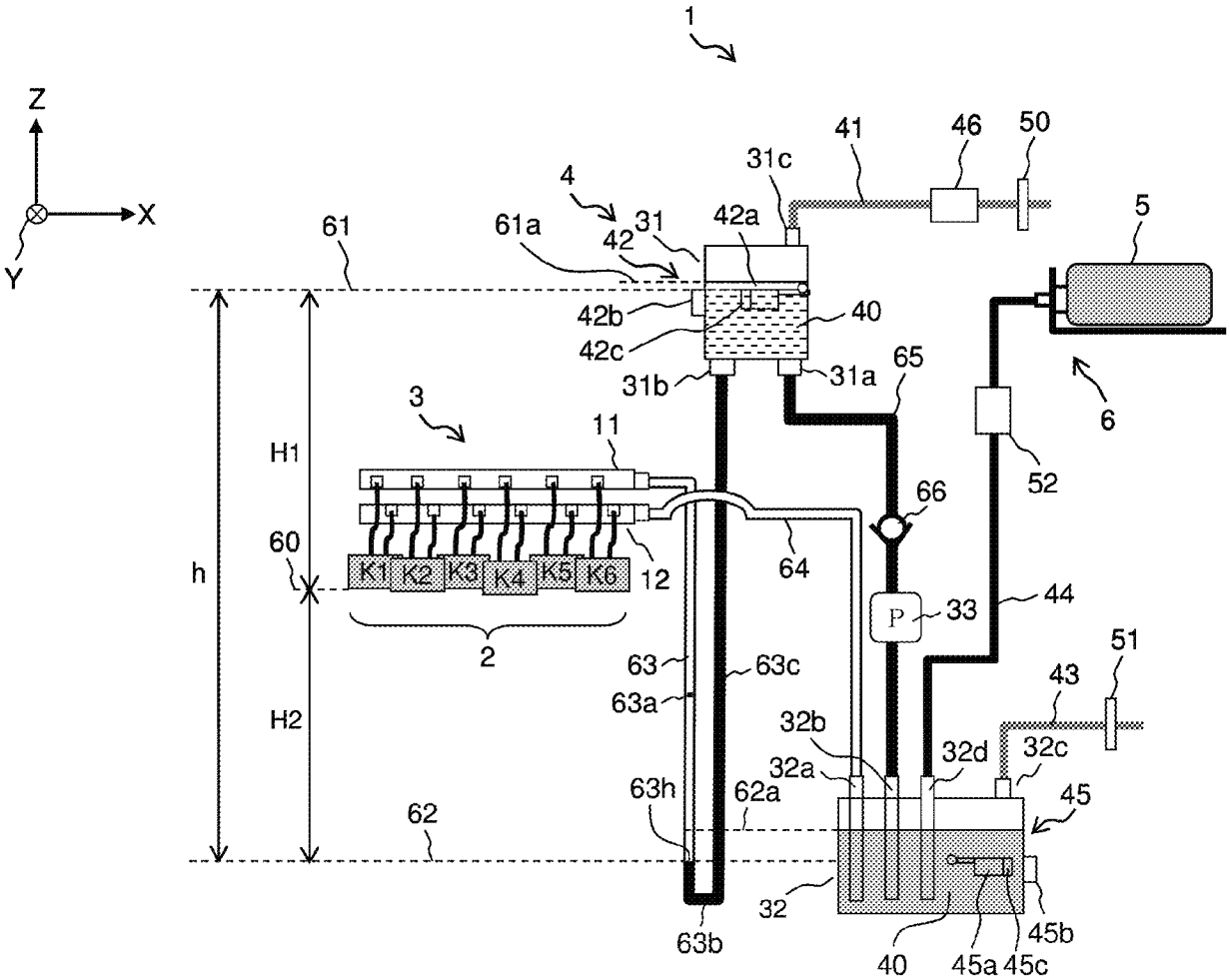
FIG. 1B is a conceptual diagram presenting an example of the operation of an ink path of an ink jet printer being an embodiment of the present invention.

FIG. 1B is a conceptual diagram presenting an example of the operation of an ink path of an ink jet printer being an embodiment of the present invention.

Meanwhile, in FIG. 1A, illustration of configurations provided in a normal ink jet printer, such as a feeding unit feeding a recording medium, a carrying unit carrying the fed recording medium, a discharge unit sending out a recording medium on which an image has been formed, a cleaning unit cleaning the ink head, a control unit performing control of the entirety of the apparatus including ink discharge control is omitted.

An ink jet printer 1 in of the present embodiment illustrated in FIG. 1A records an image on a recording medium using ink of four types of colors including cyan (C), magenta (M), yellow (Y), black (B). FIG. 1A presents the configuration of an ink path for ink 40 of a representative color.

The ink jet printer 1 of the embodiment has, according to a broad classification, an ink circulation unit 4 (ink circulation path) and a replenishing unit 6 for replenishing the ink circulation unit 4 with the ink 40.

First, the replenishing unit 6 is explained. The replenishing unit 6 has a cartridge holding unit 7, a replenishing path 44 connecting the cartridge holding unit 7 and the ink circulation unit 4, and a refill valve 52 provided in the replenishing path 44.

The cartridge holding unit 7 holds an ink cartridge 5 at a predetermined position. The cartridge holding unit 7 is provided with a joint section connected to the ink supply port of the ink cartridge 5.

The opening and closing operations of the refill valve 52 are controlled according to the ink volume in the ink circulation unit 4. In other words, as described later, when the ink volume in the ink circulation unit 4 is smaller than a predetermined volume, the refill valve 52 is released to supply the ink 40. On the other hand, when the ink volume in the ink circulation unit 4 is larger than a predetermined volume, the refill valve 52 is closed.

Next, the ink circulation unit 4 is explained.

The ink circulation unit 4 includes a first tank 31, an image recording unit 3, a first path 63 (first ink path) connecting the first tank 31 and the image recording unit 3, a second tank 32, a second path 64 (second ink path) connecting the image recording unit 3 and the second tank 32, and a third path 65 (third ink path) having a pump 33 and a one-way valve 66, and connecting the first tank 31 and the second tank 32.

Then, in the ink circulation unit 4, during the recording of an image, the ink 40 flows (circulates) in order of the first tank 31, the image recording unit 3, the second tank 32, and the first tank 31.

Here, individual configurations of the ink circulation unit 4 is explained.

The first tank 31 is disposed above the image recording unit 3 in the direction of the gravitational force. More specifically, the first tank 31 is arranged so that an ink liquid level 61 in the first tank 31 is above a nozzle plate plane 60 of a line head 2 (ink head) of the image recording unit 3 described later in the gravitational force direction by a height H1.

Provided in the first tank 31 are an ink inlet port 31*a*, an ink outlet port 31*b*, and an atmosphere release port 31*c*. In addition, in the first tank 31, a liquid level detection unit 42 is provided to maintain the position of the ink liquid level 61 at a predetermined height.

The ink inlet port 31*a* is connected to an end of the third path 65. The ink inlet port 31*a* lets the ink 40 pumped from the second tank 32 by the pump 33 flow into the first tank 31.

Meanwhile, it is preferable to arrange the ink inlet port 31*a* below the ink liquid level 61 in the first tank 31 in the perpendicular (gravitational force) direction so as not to trap air bubbles in the ink 40 stored in the first tank 31.

The ink outlet port 31*b* is connected to an end of the first path 63. The ink outlet port 31*b* lets the ink 40 in the first tank 31 outflow by the gravitational force, to supply it to the image recording unit 3.

The atmosphere release port 31*c* is connected to an atmosphere release path 41 in which an atmosphere release valve 46 and a filter 50 are provided.

The atmosphere release value 46 lets the inside of the first tank 31 communicate with the atmosphere or isolates the inside of the first tank 31 from the atmosphere by opening and closing operations. In other words, when the atmosphere release valve 46 is released, the inside of the first tank 31 communicate with the atmosphere through the filter 50 and the atmosphere release path 41. On the other hand, when the atmosphere release valve 46 is closed, the inside of the first tank 31 is isolated from the atmosphere. In addition, the filter 50 prevents dusts in the atmosphere from being trapped in the first tank 31.

While the atmosphere release valve 46 is placed between the first tank 31 and the filter 50, the filter 50 may be placed between the first tank 31 and the atmosphere release valve 46.

The liquid level detection unit 42 provided in the first tank 31 has a float member 42*a*, a liquid level position sensor 42*b*, a magnet 42*c*. The magnet 42*c* is attached to the float member 42*a*. In addition, the float member 42*a* is supported to the interior wall of the first tank 31 by an axis to be able to swing up and down, and the side to which the magnet 42*c* is attached swings up and down according to the height of the liquid level of the ink 40 in the first tank 31.

The liquid level position sensor 42*b* consists of a magnetic sensor, and detects the magnetic force of the magnet 42*c* attached to the float member 42*a*. Accordingly, the liquid level position sensor 42*b* detects the position of the float member 42*a*, that is, the ink liquid level 61.

In this case, when the ink liquid level 61 is at a predetermined height, the liquid level position sensor 42*b* detects the magnet 42*c* and turns ON, and turns OFF when the ink liquid level 61 goes down.

Thus, the liquid level detection unit 42 is provided to maintain the volume of ink stored in the first tank 31 at a predetermined volume.

Meanwhile, the liquid level detection unit 42 is not limited to the configuration described above, as long as it can detect the position of the ink liquid level 61. For example, a part of the wall of the first tank 31 may be made with a transparent material, and the liquid level detection unit 42 may detect the position of the liquid level directly by an optical sensor.

The image recording unit 3 has a line head 2 as an ink discharge unit, an ink distributor 11 for distributing the ink 40 to the line head 2, and an ink collector 12 for collecting the ink 40 from the line head 2.

The ink distributor 11 is connected to the other end of the first path 63 and the line head 2. Then, the ink distributor 11 distributes the ink 40 flowing out of the first tank 31 to the line head 2.

The ink collector 12 is connected to an end of the second path 64 and the line head 2. Then, the ink collector 12 collects the ink 40 that was not discharged from the line head 2.

The pressure in the line head 2 (nozzle hole pressure Pn) is maintained at a negative pressure that is appropriate for the printing operation (in this embodiment, a gauge pressure of about −1 kPa) during the ink circulation. Accordingly, an inwardly and spherically concave meniscus is formed in the nozzle. Then, the line head 2 discharges the ink 40 according to an image signal input from an external apparatus, to record an image on a recording medium.

While the ink distributor 11 is provided in this embodiment, the first tank 31 and the line head 2 may be connected directly. In the same manner, while the ink collector 12 is provided in this embodiment, the second tank 32 and the line head 2 may be connected directly.

In addition, the line head 2 of the embodiment is formed by, for example, as illustrated in FIG. 1A, using a plurality of ink heads K1-K6 that are not as wide as the width of the recording medium, and arranging the ink heads K1-K6 in a zigzag alignment in the width direction (in this case, the X direction) of the recording medium.

An end of the first path 63 connecting first tank 31 and the image recording unit 3 is connected to the ink outlet port 31*b* of the first tank 31, and its other end is connected to the ink distributor of the image recording unit 3.

Meanwhile, the first path 63 consists of, for example, a pipe-shaped duct line or a tube formed with a resin or metal.

In the case of this embodiment, the position of at least apart of the first path 63 is equivalent to an ink liquid level 62 in the second tank 32 or lower than the ink liquid level 62 in the gravitational force direction. In other words, the position of at least a part of the first path 63 is equivalent to the position on which a liquid level detection unit 45 in the second tank 32 described later, or lower than the position on which the liquid level detection unit 45.

As an example, the first path 63 of this embodiment is formed as an approximately-U-shaped path. Then, the first path 63 has paths 63*a*, 63*c* that extend approximately linearly (linear sections), and a bent section (curved section) 63*b*.

Accordingly, the bent section 63*b* is at the lowest position in the perpendicular direction (gravitational force direction) in the first path 63, and in the case of the present embodiment, the height of the bent section 63*b* is configured so as to be lower than the ink liquid level 62 of the second tank 32 described later.

In addition, when the atmosphere release valve 46 is opened, the first path 63 lets the ink 40 in the first tank 31 into the ink distributor 11 by the water head difference (height H1) between the first tank 31 an the image recording unit 3. At this time, the amount of the ink 40 that is larger than the maximum ink volume discharged from the nozzles of the line head 2 is flown from the first tank 31 to the ink distributor 11.

Meanwhile, when the atmosphere release valve 46 is closed, the ink 40 does not flow in the first path 63. In other words, the ink 40 in the first tank 31 does not flow into the ink distributor 11.

The second tank 32 is disposed below the image recording unit 3 in the gravitational force direction. More specifically, the first tank 31 is arranged so that the ink liquid level 62 in the second tank 32 is below a nozzle plate plane 60 of a line head 2 in the gravitational force direction by a height H2.

Provided in the second tank 32 are an ink inlet port 32*a*, an ink outlet port 32*b*, and an atmosphere release port 32*c*, and a refill port 32*d*. In addition, in the second tank 32, a liquid level detection unit 45 is provided.

The ink inlet port 32*a* is connected to the other end of the second path 64. The ink 40 collected by the ink collector 12 flows into the ink inlet port 32*a*.

The ink outlet port 32*b* is connected to the other end of the third path 65. The ink outlet port 32*b* lets the ink 40 in the second tank 32 flow toward the first tank 31.

The atmosphere release port 32*c* is connected to the atmosphere release path 43 in which a filter 51 is disposed. For this reason, the inside of the second tank 32 is always in communication with the atmosphere through the filter 51 and the atmosphere release path 43. The filter 51 prevents dusts in the atmosphere from being trapped in the second tank 32.

The refill port 32*d* is connected to the replenishing unit 6 through the replenishing path 44 and the refill valve 52. When the refill valve 52 is released, the ink 40 in the ink cartridge 5 flows into the refill port 32*d*.

While, in this embodiment, the ink 40 is flown (supplied) to the refill port 32*d* by opening the refill valve 52, the ink 40 may be flown (supplied) to the refill port 32*d* by a pump and the like instead of the refill valve 52.

The liquid level detection unit 45 is in a similar configuration as the liquid level detection unit 42 described above, and is provided to maintain the volume of ink stored in the second tank 32 at a predetermined volume.

In other words, the liquid level detection unit 45 detects the position of a float member 45*a*, that is, the ink liquid level 62 in the second tank 32 by detecting a magnet 45*c* attached to the float member 45*a* by the liquid level position sensor 45*b*.

Here, the opening and closing operations of the refill valve 52 are performed according to the detection result by the liquid level detection unit 45 so as to maintain the ink liquid level 62 in a predetermined range. Specifically, when the liquid level detection unit 45 is ON, it is determined that the ink volume in the second tank 32 is sufficient, and the refill valve 52 is in the closed state.

On the other hand, when the liquid level detection unit 45 is OFF, it is determined that the ink volume in the second tank 32 is insufficient, and the refill valve 52 enters the open state. By this operation, the second tank 32 is refilled with the ink 40 in the ink cartridge 5, and the ink liquid level 62 in the second tank 32 is maintained in the predetermined range.

An end of the second path 64 is connected to the ink collector 12 of the image recording unit 3, and its other end is connected to the ink inlet port 32*a* of the second tank 32. Meanwhile, the second path 64 consists of, for example, a pipe-shaped duct line or a tube formed with a resin or metal.

When the atmosphere release valve 46 is opened, the second path 64 lets the ink 40 collected by the ink collector 12 flow into the second tank 32 by the water head difference (difference in height). Meanwhile, when the atmosphere release valve 46 is closed, the ink 40 does not flow into the second path 64.

An end of the third path 65 is connected to the ink inlet port 31*a* of the first tank 31, and its other end is connected to the ink outlet port 32*b* of the second tank 32. In the third path 65, a pump 33 and a one-way valve 66 are provided. Meanwhile, the third path 65 consists of, for example, a pipe-shaped duct line or a tube formed with a resin or metal. In addition, if the pump 33 itself has the function of a one-way valve, the one-way valve 66 does not need to be provided in the third path 65.

The activation and stop of the pump 33 is performed according to the detection result by the liquid level detection unit 42 so as to maintain the ink liquid level 61 in the predetermined range.

Specifically, when the liquid level detection unit 42 is ON, it is determined that the ink volume in the first tank 31 is sufficient, and the pump 33 is stopped. On the other hand, when the liquid level detection unit 42 is OFF, it is determined that the ink volume in the first tank 31 is insufficient, and the pump 33 is activated.

According to this operation, the ink 40 in the second tank 32 is supplied to the first tank 31. Then, the ink liquid level 61 is maintained in a predetermined range.

Meanwhile, in this embodiment, the liquid delivery capacity of the pump 33 is designed so that an amount of ink that is larger than the amount of ink flowing out of the first tank 31 can be delivered to the first tank 31. Accordingly, when the ink circulation operation is performed, the pumping operation of the pump 33 is performed intermittently.

In addition, the one-way valve 66 is disposed on the ink discharge side of the pump 33 in the third path 65 (the path on the liquid delivery side to the first tank 31). The one-way valve 66 prevents backward flow of the ink 40 (flow from the first tank 31 to the second tank 32) due to the difference in height between the ink liquid level 61 in the first tank 31 and the ink liquid level 62 in the second tank 32.

That is, when the pump 33 stops, the ink 40 in the first tank 31 tends to flow backward to the second tank 32 due to the water head difference (difference in height). The one-way valve 66 prevents this flow.

In the ink jet printer 1 of this embodiment configured as described above, when recording an image on the recording medium, the atmosphere release valve 46 is released, to let the inside of the first tank 31 enter the atmosphere release state. Accordingly, the ink 40 in the first tank 31 runs down to the second tank 32 through the line head 2 due to the gravitational force (water head difference).

Then, the operations of the pump 33 and the refill valve 52 are controlled as described above according to the ink volume in the first tank 31 and the second tank 32.

That is, the ink 40 circulates so as to flow in the order of the first tank 31, the ink distributor 11, the line head 2, the ink collector 12, the second tank 32, the pump 33, the one-way valve 66 and to return again to the first tank 31.

In addition, when the ink jet printer 1 is standing by or during the no-ink-circulation period as the power is shut down, the atmosphere release valve 46 is closed, isolating the inside of the first tank 31 from the atmosphere. At this time, the second tank 32 is disposed below the line head 2 in the gravitational force direction as described above. Therefore, a meniscus is formed in the nozzle of the line head 2 by the water head difference between the line head 2 and the second tank 32. That is, during the no-ink-circulation period, the ink 40 does not drip down from the line head 2.

Meanwhile, the positional relationship between the nozzle plate plane 60 of the line head 2, the ink liquid level 61 of the first tank 31 and the ink liquid level 62 of the second tank 32 and the paths (the path length and the thickness of the first path 63 and the path length and the thickness of the second path 64) are set so that a pressure that is appropriate for printing (for example, the nozzle hole pressure Pn as the nozzle pressure in the ink-circulation state of about −1 kPa) is applied to the inside of the line head 2.

Next, impacts on the ink circulation unit 4 of shaking or shock occurring from transportation upon delivery (transportation) of the ink jet printer 1 according to the present embodiment, and movement of the ink 40 in the ink circulation unit 4 are explained.

FIG. 1A described above presents the state of the ink circulation unit 4 that is transportable as the power of the ink jet printer 1 of the present embodiment is shut down. That is, the atmosphere release valve 46 is closed, and it is in the no-ink-circulation state.

Meanwhile, FIG. 1B presents a change in the state of the ink 40 in the ink circulation unit 4 due to shaking and shock occurring from transportation upon delivery (transportation) of the ink jet printer according to the embodiment 1.

Meanwhile, in FIG. 1A, FIG. 1B, when the first path 63, the second path 64, the third path 65 are filled with the ink 40, they are represented with solid lines (thick lines), and when the ink 40 has flown out and air has been trapped, they are represented with hollow lines (only the frames are solid lines).

Meanwhile, the ink volume stored in the first tank 31 is indicated with the height of the ink liquid level, and increases in the ink volume in the tank are indicated in the direction in which the liquid level rises. In the same manner, the ink volume stored in the second tank 32 is indicated with the height of the ink liquid level, and increases in the ink volume in the tank are indicated in the direction in which the liquid level rises.

First, using FIG. 1A, the state of the inside of the ink circulation unit 4 before transportation and when the power of the ink jet printer is shut down is explained. As the power is shut down, the atmosphere release valve 46 is in the closed state.

The ink circulation unit 4 is filled with ink. That is, the first path 63, the second path 64 and the third path 65 are filled with the ink 40. In addition, the ink stored in the first tank 31 has the ink liquid level 61, and the ink stored in the second tank 32 has the ink liquid level 62.

The inside of the line head 2 is in a pressure (negative pressure) that is lower than the atmospheric pressure P0 due to the positional relationship between the nozzle plate plane 60 of the line head 2 and the ink liquid level 62 of the second tank 32. For example, assuming the difference in height between the nozzle plate plane 60 of the line head 2 and the ink liquid level 62 of the second tank 32 as H2, the density of the ink 40 as ρ, the gravitational acceleration as g, the pressure Pn on the nozzle hole of the line head 2 is, $$Pn=-\rho\times g\times H2.$$

The sign of the pressure Pn is negative as it indicates a pressure (negative pressure) that is lower than the atmospheric pressure P0.

Meanwhile, the inside of the first tank 31 is in a pressure p1 (negative pressure) that is lower than the atmospheric pressure P0 due to the positional relationship between the ink liquid level 61 of the first tank 31 and the ink liquid level 62 of the second tank 32.

For example, assuming the difference in height between the nozzle plate plane 60 and the ink liquid level of the first tank 31 as H1, the difference in height between the nozzle plate plane 60 and the ink liquid level 62 of the second tank 32 as H2, the density of the ink 40 as ρ, the gravitational acceleration as g, the pressure (internal pressure) P1 in the inside of the first tank 31 is, $$P1=-\rho\times g\times(H1+H2).$$

The sign of the pressure P1 is negative as it indicates a pressure (negative pressure) that is lower than the atmospheric pressure P0. In addition, the pressure P1 is a larger negative pressure than the pressure Pn mentioned above (the absolute value of the pressure value of P1 is larger than that for Pn).

Meanwhile, the inside of the second tank 32 is in communication with the atmosphere through the filter 51. For this reason, the pressure inside the second tank 32 is equivalent to the atmospheric pressure P0.

Next, referring to FIG. 1B, a change in the state when the meniscus is destroyed upon transportation due to application of shaking and shock occurring from transportation and air is trapped in the ink circulation unit 4 is described.

The third path 65 is filled with ink as the one-way valve 66 is disposed, in the same manner as before the transportation. However, air enters the first path 63, the second path 64 and the image recording unit 3 (the line head 2, the ink distributor 11, the ink collector 12). This is caused by the influence of destruction of the meniscus formed in the nozzle hole of the line head 2 by shaking and shock. That is, this is because air enters the ink circulation unit 4 (ink path) due to the destruction of the meniscus. In particular, when experiencing shaking and shock repeatedly, the formation and destruction of the meniscus is repeated, and ink leakage and air intake from the nozzle hole are repeated until the pressure balance in the ink circulation unit 4 stabilizes.

Then, in this embodiment, as illustrated in FIG. 1B, a part of the first path 63 (in this case, the bent section 63*b*) is in a positional relationship in which it is lower than the ink liquid level 62 of the second tank 32 in the perpendicular direction (gravitational force direction).

For this reason, in the path 63*a* of the first path 63, air enters up to the vicinity of the ink liquid level 62 of the second tank 32. However, since the bent section 63*b* is in the position that is lower than the ink liquid level 62, further entrance of air is prevented. That is, from the ink liquid level 62 of the path 63*a* to the bent section 63*b* and the path 63*c* is filled with the ink 40. Meanwhile, ink in the second path 64 runs down to the second tank 32.

Explaining it in greater detail, when the meniscus of the nozzle hole is destroyed by shaking or shock, air enters from the nozzle hole. This makes the ink 40 inside the line head 2 run down to the second tank 32 through the second path 64 or flow outside from the nozzle hole. Then, eventually, a part or all of the ink in the line head 2, the ink distributor 11 and the ink collector 12 runs down to the second tank 32 through the second path 64 due to difference in height. That is, the inside of the second path 64 enters the empty state (the state in which air has been entered) with the ink 40 having flown out, and the ink liquid level 62 in the second tank 32 rises to an ink liquid level 62*a*. Meanwhile, the second tank 32 has a capacity with which at least overflow does not occur even if the ink in the second path 64 runs down. Optimally, it is preferable to that the second tank 32 has a capacity with which overflow does not occur even if the ink in the second path 64 and the image recording unit 3 runs down. Thus, the inside of the line head 2, the ink distributor 11, the ink collector 12 is filled with air.

Meanwhile, the first path 63 is separated from the second path 64 by the trapped air. In other words, the first path 63 and the second path 64 enters the state in which they are not in communication through the image recording unit 3 (line head 2, the ink distributor 11, the ink collector 12) by way of ink (no-communication state). When entering the no-communication state as described above, since the pressure inside the first tank 31 is a negative pressure as described above, the ink 40 in the first path 63 is sucked up toward the first tank 31. Then, when the liquid level of the ink 40 in the first path 63 reaches a position 63*h*, the suction stops. Accordingly, the ink liquid level 61 in the first tank 31 rises by the amount of the sucked ink while the amount of change is small, and reaches the ink liquid level 61*a*. Here, the position 63*h* is the position at which the difference in height from the ink liquid level 62 in the second tank 32 to the ink liquid level 61 in the first tank 31 in the state in which the first path 63 and the second path 64 are in communication through the image recording unit 3 by way of ink (communication state) and the difference in height from the position 63*h* of the ink liquid level in the first path 63 (in the path 63*a*) to the ink liquid level 61*a* in the first path 63 in the no-communication state are approximately the same. In other words, the position 63*h* is the height position that is approximately equivalent to the ink liquid level 62 in the second tank 32 in the gravitational force direction. Thus, in the first path 63, air enters up to a height close to the ink liquid level 62 in the path 63*a*, but air does not enter further than that in the first path 63 on the first tank 21 side (the bent section 63*b*, the path 63*c*). In other words, air that has entered the first path 63 does not enter the bent section 63*b* and the path 63*c*.

As described above, in this embodiment, apart of the first path 63 (in this case, the bent section 63*b*) is positioned lower than the ink liquid level 62 in the second tank 32, so the position 63*h* of the ink liquid level in the first path 63 (in the path 63*a*) does not come to the position that is lower than the ink liquid level 62 in the second tank 32 in the gravitational force direction. Therefore, the ink 40 in the first tank 31 does not run down to the second tank 32. That is, the first tank 31 never runs out of ink. Therefore, since there is sufficient ink 40 left in the first tank 31, by an operation that is equivalent to the normal ink circulation to release the atmosphere release valve 46 to let ink flow from the first tank 31 to the second tank 32 after the power of the ink jet printer is turned on, the inside of the ink circulation unit 4 can be filled with the ink 40. In addition, as an another method, the ink 40 can be supplied by driving the pump 33 in the state in which the atmosphere release valve 46 of the first tank 31 to apply a pressure to the inside of the first tank 31 to push out the ink 40 remaining in the first tank 31 swiftly.

As a result, even if the meniscus of the nozzle hole is destroyed by shaking or shock and air enters from the nozzle hole, the second tank 32 does not experience overflow, and recovery of the ink jet printer to the state in which it can conduct printing can be performed easily.

That is, in the ink jet printer 1 in having the ink circulation unit 4 in which the first tank 31 and the second tank 32 are placed above and below the image recording unit 3 having the line head to circulate the ink 40, leakage of the ink 40 from the ink circulation unit 4 due to shaking, shock and the like can be prevented certainly at a low cost, without disposing an electromagnetic valve with a complicated and expensive mechanism in the first path 63 extending from the first tank 31 to the image recording unit 3.

(Embodiment 2)

Figure 2A:
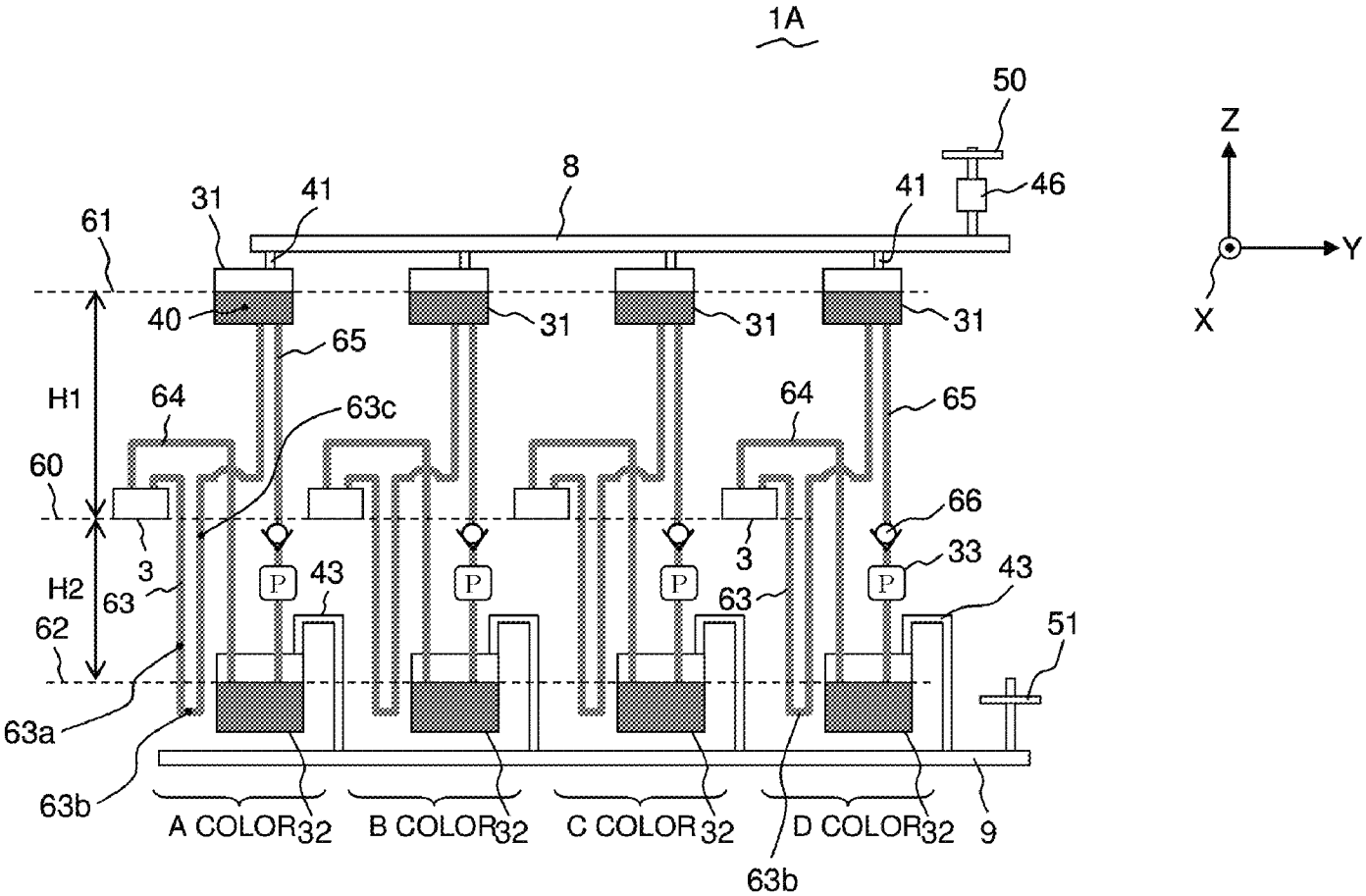
FIG. 2A is a conceptual diagram presenting a configuration example of an ink path of an inkjet printer in another embodiment of the present invention.

FIG. 2A is a conceptual diagram illustrating the ink path of an ink jet printer in another embodiment of the present invention.

FIG. 2B, FIG. 2C, FIG. 2D, FIG. 2E are conceptual diagrams illustrating examples of operations of the ink path of the ink jet printer of another embodiment of the present invention.

That is, FIG. 2B-FIG. 2E represents the state in which air is sucked into the ink path from the nozzle hole of the ink head due to shaking or shock and the like in transportation.

Meanwhile, in the embodiment 2 below, the same numerals are assigned to the configurations that are the same as in the embodiment 1 described above, and overlapping description is omitted. In addition, in FIG. 2A-FIG. 2E, numerals are assigned only the representative constituents as needed, in order to avoid making the illustration complicated.

An ink jet printer 1A of the embodiment 2 uses four colors of ink. For this reason, the ink jet printer 1A of the embodiment 2 has a plurality of the ink circulation units in the configuration in the FIG. 1A described above. Meanwhile, the atmosphere release valve 46 and the filter 50 are shared for use between a plurality of first tanks 31. In addition, the filter 51 is shared for use between a plurality of second tanks 32.

That is, in the ink jet printer 1A of the embodiment 2, a first tank shared air chamber 8 connected to the atmosphere release path 41 of each of the first tanks 31 is provided, and a single atmosphere release valve 46 and a single filter 50 are provided in the first tank shared air chamber 8.

In the same manner, a second tank shared air chamber 9 connected to the atmosphere release path 43 of each of the second tanks 32 is provided, and a single filter 51 is provided in the second tank shared air chamber 9.

Thus, in the ink jet printer 1A of the embodiment 2, as illustrated in FIG. 2A, while independent ink circulation units 4 (ink flow paths) are provided for the four systems, the first tank shared air chamber 8, the second tank shared air chamber 9, the atmosphere release valve 46, the filter 50, the filter 51 are shared for all the colors.

Accordingly, the inside of the first tank shared air chamber 8 is released/isolated to/from the atmosphere by opening/closing (releasing/shutting) the atmosphere release valve 46. That is, since the first tank shared air chamber 8 is connected to each of the first tanks 31, the inside of each of the first tanks 31 can be released/isolated to/from the atmosphere simultaneously.

In addition, since the atmosphere release path 43 is connected to the second tank shared air chamber 9, the inside of each of the second tanks 32 is in communication with the atmosphere through the filter 51.

In the ink jet printer 1A of the embodiment 2 configured as described above, when recording an image on a recording medium, in the same manner as in the embodiment 1 described above, the atmosphere release valve 46 is released, to let the inside of the first tanks 31 enter the atmosphere release state. Accordingly, the ink 40 in the first tanks 31 for all the colors runs down to the second tank 32 via the line head 2, lowering the ink liquid level 61 in the first tank 31 and rising the ink liquid level 62 in the second tank 32.

Then, the operation of the pump 33 and the refill valve 52 of each color is controlled according to the ink volume in the first tank 31 and the second tank 32 of each color. That is, for all the colors, ink circulates so as to flow in the order of the first tank 31, the ink distributor 11, the line head 2, the ink collector 12, the second tank 32, the pump 33, the one-way valve 66 and to return again to the first tank 31.

The positional relationship between the nozzle plate plane 60 of the line head 2, the ink liquid level 61 of the first tank 31 and the ink liquid level 62 of the second tank 32 and the paths (the path length and the thickness of the first path 63 and the path length and the thickness of the second path 64) are set so that a pressure that is appropriate for printing (for example, the nozzle hole pressure Pn as the nozzle pressure in the ink-circulation state of about −1 kPa) is applied to the inside of the line head 2, more specifically, in the vicinity of the nozzle hole in the line head 2 during the ink circulation period. Accordingly, a meniscus is formed in the nozzle hole.

Meanwhile, when the ink jet printer 1A is standing by and when the power is shut down, the atmosphere release valve 46 is closed, isolating the inside of the first tanks 31 for all the colors from the atmosphere.

At this time, since the second tank 32 is disposed below the line head 2 in the gravitational force direction as described above, a meniscus is formed in the nozzle of the line head 2 by the water head difference between the line head 2 and the second tank 32. That is, during the standby period, the ink 40 does not drip down from the line head 2.

Next, impacts on the ink circulation unit 4 of shaking or shock occurring from transportation upon delivery (transportation) of the ink jet printer 1A according to the embodiment 2, and movement of the ink 40 in the ink circulation unit 4 are explained.

FIG. 2A presents the state of the ink circulation unit 4 that is transportable as the power of the ink jet printer 1A is shut down. All the four colors have ink configuration units in the similar configuration, and presented as A color, B color, C color, D color from the left.

Figure 2B:
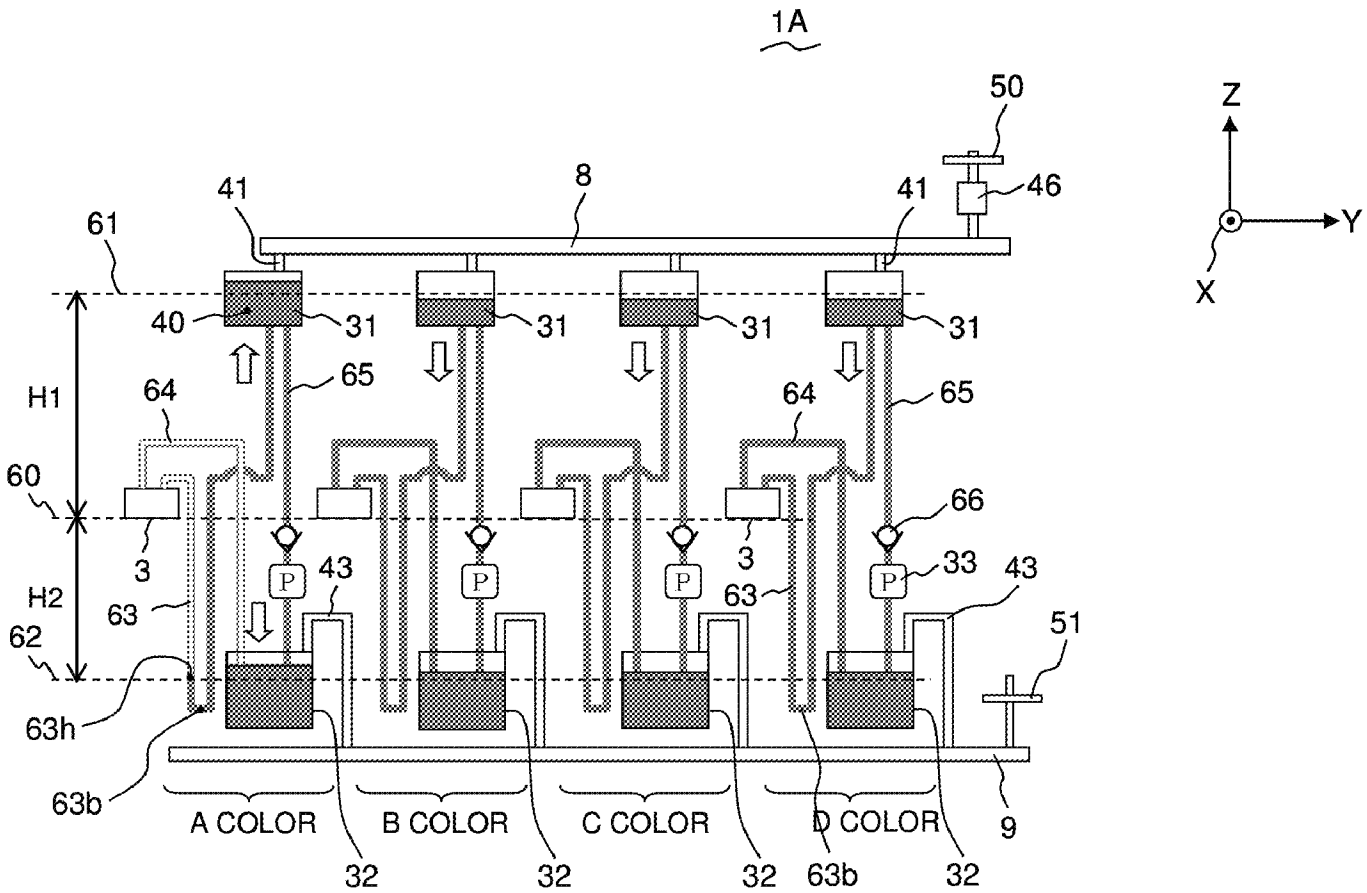
FIG. 2B is a conceptual diagram presenting an example of the operation of an ink path of an ink jet printer in another embodiment of the present invention.

FIG. 2B presents the state in which, upon transportation of the ink jet printer of the embodiment 2, the meniscus in the line head 2 of one color (A color) of the four colors has been destroyed by shaking or shock caused by the transportation and air has entered into the ink circulation unit 4.

Figure 2C:
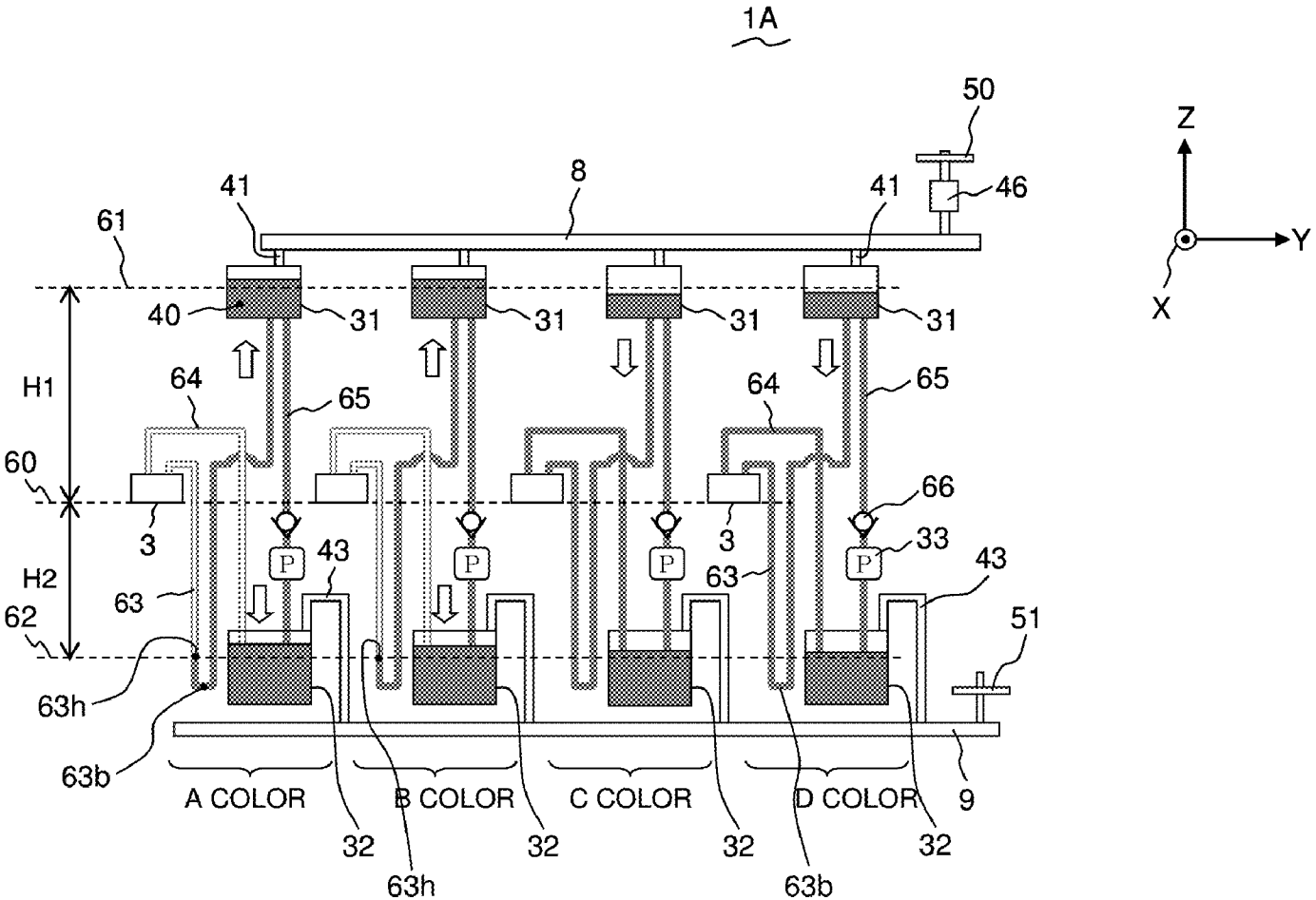
FIG. 2C is a conceptual diagram presenting an example of the operation of an ink path of an ink jet printer in another embodiment of the present invention.

FIG. 2C presents the state in which, upon transportation of the ink jet printer of the embodiment 2, the meniscus in the line head 2 of two colors (A color, B color) of the four colors has been destroyed by shaking or shock caused by the transportation and air has entered into the ink circulation unit 4.

Figure 2D:
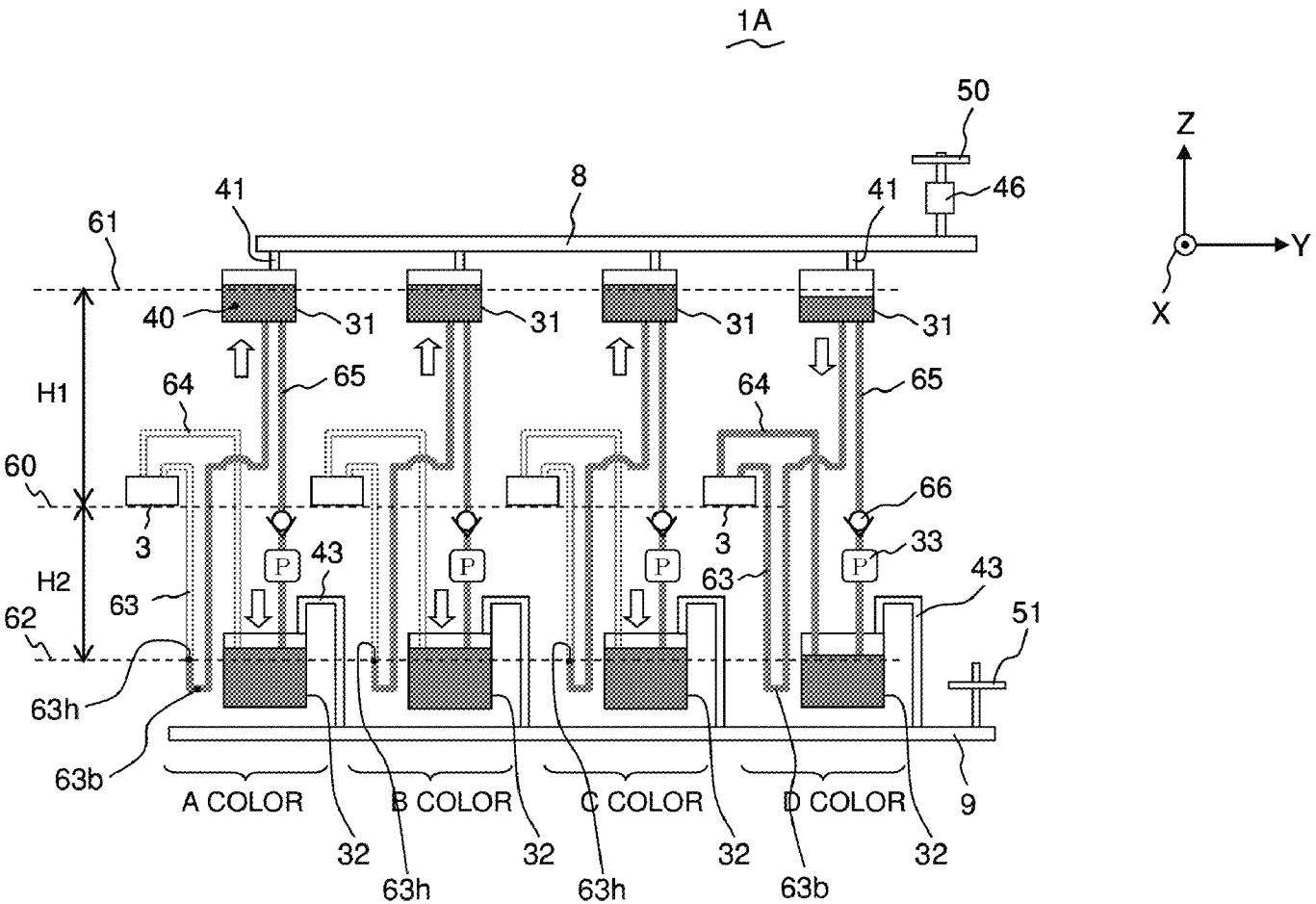
FIG. 2D is a conceptual diagram presenting an example of the operation of an ink path of an ink jet printer in another embodiment of the present invention.

FIG. 2D presents the state in which, upon transportation of the ink jet printer of the embodiment 2, the meniscus in the line head 2 of three colors (A color, B color, C color) of the four colors has been destroyed by shaking or shock caused by the transportation and air has entered into the ink circulation unit 4.

Figure 2E:
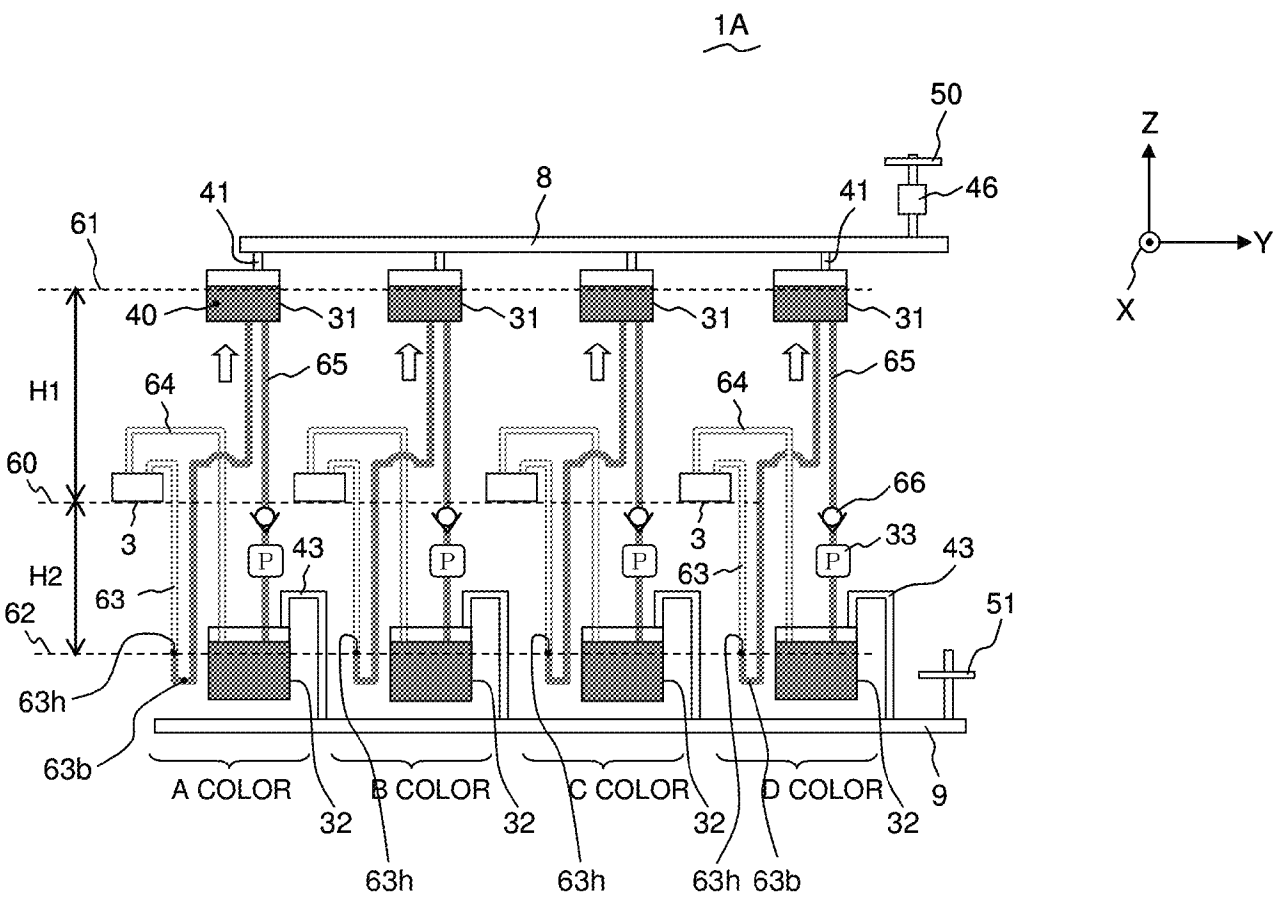
FIG. 2E is a conceptual diagram presenting an example of the operation of an ink path of an ink jet printer in another embodiment of the present invention.

FIG. 2E presents the state in which, upon transportation of the ink jet printer of the embodiment 2, the meniscus in the line head 2 of all the colors has been destroyed by shaking or shock caused by the transportation and air has entered into the ink circulation unit 4.

In FIG. 2A-FIG. 2E, the line head 2, the ink distributor 11 and the ink collector 12 are described collectively as the image recording unit 3, and details their configurations are similar to those presented in embodiment.

In FIG. 2A-FIG. 2E, when the first path 63, the second path 64, the third path 65 are filled with the ink 40, they are represented with solid lines (thick lines), and when the ink 40 has flown out and air has been trapped, they are represented with hollow lines (only the frames are solid lines).

Meanwhile, the ink volume stored in the first tank 31 is indicated with the height of the ink liquid level, and increases in the ink volume in the tank are indicated in the direction in which the liquid level rises. In the same manner, the ink volume stored in the second tank 32 is indicated with the height of the ink liquid level, and increases in the ink volume in the tank are indicated in the direction in which the liquid level rises.

First, using FIG. 2A, the state of the inside of the ink circulation unit 4 before transportation and when the power of the ink jet printer is shut down is explained. As the power is shut down, the atmosphere release valve 46 is in the closed state.

The ink circulation unit 4 of all the colors is filled with ink. That is, the first path 63, the second path 64 and the third path 65 of all colors are filled with the ink 40.

In addition, the ink stored in the first tank 31 has the ink liquid level 61 for all the colors, and the ink stored in the second tank 32 has the ink liquid level 62 for all the colors.

The inside of the line head 2 is in a pressure (negative pressure) that is lower than the atmospheric pressure P0 due to the positional relationship between the nozzle plate plane 60 of the line head 2 and the ink liquid level 62 of the second tank 32. For example, assuming the difference in height between the nozzle plate plane 60 of the line head 2 and the ink liquid level 62 of the second tank 32 as H2, the density of the ink 40 as ρ, the gravitational acceleration as g, the pressure Pn on the nozzle hole of the line head 2 is, $$Pn=-\rho\times g\times H2.$$

The sign of the pressure Pn is negative as it indicates a pressure (negative pressure) that is lower than the atmospheric pressure P0.

Meanwhile, the inside of the first tank 31 is in a pressure P1 (negative pressure) that is lower than the atmospheric pressure P0 due to the positional relationship between the ink liquid level 61 of the first tank 31 and the ink liquid level 62 of the second tank 32.

For example, assuming the difference in height between the nozzle plate plane 60 and the ink liquid level of the first tank 31 as H1, the difference in height between the nozzle plate plane 60 and the ink liquid level 62 of the second tank 32 as H2, the density of the ink 40 as ρ, the gravitational acceleration as g, the pressure (internal pressure) P1 in the inside of the first tank 31 is, $$P1=-\rho\times g\times(H1+H2).$$

The sign of the pressure P1 is negative as it indicates a pressure (negative pressure) that is lower than the atmospheric pressure P0. In addition, the pressure P1 is a larger negative pressure than the pressure Pn mentioned above (the absolute value of the pressure value of P1 is larger than that for Pn).

Meanwhile, the inside of the second tank 32 is in communication with the atmosphere through the filter 51. For this reason, the pressure inside the second tank 32 is equivalent to the atmospheric pressure P0.

Next, using FIG. 2B, a change in the state when the meniscus in the line head 2 of one color (A color) of the four colors is destroyed due to application of shaking and shock and air is trapped in the ink circulation unit 4 is described.

The third path 65 for all of the A color-D color is filled with the ink 40 as the one-way valve 66 is disposed, in the same manner as before the transportation.

In addition, the first path 63 and the second path 64 for the colors other than the A color are respectively filled with the ink 40. In addition, the height of the ink liquid level of the first tank 31 of the colors other than the A color is at a position that is lower than the ink liquid level 61 before transportation (the ink volume in the tank has decreased). Furthermore, the height of the ink liquid level of the second tank 32 of the colors other than the A color is at a position that is raised above the ink liquid level 62 before transportation (the ink volume in the tank has increased).

In the first path 63 of the A color, air enters up to a height near the ink liquid level 62 of the second tank 32, but for the same reason as in the embodiment 1 described above, air does not enter further in the first path 63. Meanwhile, the height of the ink liquid level in the first tank 31 for the A color reaches a position that is raised above the ink liquid level 61 (the ink volume in the tank has increased).

In addition, ink in the second path 64 for the A color runs down to the second tank 32 for the same reason as in the embodiment 1 described above, and air has entered. Meanwhile, the height of the ink liquid level in the second tank 32 for the A color reaches a position that is raised above the ink liquid level 62 (the ink volume in the tank has increased).

The reason why the ink liquid levels in the first tank 31 and the second tank 32 for the A color both rise is that the air entering from the line head 2 of the A color separates the first path 63 and the second path 64, and the ink 40 in the first path 63 and the second path 64 flows separately into the first tank 31 and the second tank 32.

In addition, at this time, due to the influence of the first tank shared air chamber 8 communicating with the first tanks 31 of all the colors, the ink 40 in the tanks moves so that the pressures in the first tanks 31 of all the colors become equal.

Explaining it in greater detail, the first tanks 31 of all the colors including the first tank shared air chamber is hermetically sealed. For this reason, an approximately constant air volume is maintained, and the ink 40 moves so that the water head difference between the ink liquid level of the first tank 31 and the second tank 32 for all the colors becomes equal.

That is, since the ink 40 in the first path 63 has been sucked up into the first tank 31 and the ink liquid level has risen for the A color, the raised amount is distributed to the remaining three paths (the B color, C color, D color) approximately evenly.

In other words, the liquid level of the first tank 31 for the other three paths decreases by the amount of increase in the ink 40 in the first tank 31 for the A color. The ink 40 runs down to the second tank 32 through the line head 2 by the amount of the decrease of the liquid level. Therefore, the ink liquid level in the second tank 32 for the colors other than the A color also increases.

Next, using FIG. 2C, a change in the state when the meniscus in the line head 2 of two colors (the A color, B color) of the four colors is destroyed due to application of shaking and shock and air is trapped in the ink circulation unit 4 is described.

Also in this case, the third path 65 for all of the A color-D color is filled with the ink 40 as the one-way valve 66 is disposed, in the same manner as before the transportation.

The first path 63 and the second path 64 for the C color and the D color are respectively filled with the ink 40. In addition, the height of the ink liquid level of the first tank 31 of the C color and the D color is at a position that is lower than the ink liquid level 61 before transportation. Furthermore, the height of the ink liquid level of the second tank 32 of the C color and the D color is at a position that is raised above the ink liquid level 62 before transportation.

In the first path 63 of the A color and the B color, air enters up to a height near the ink liquid level 62 of the second tank 32, but for the same reason as in the embodiment 1 described above, air does not enter further in the first path 63. Meanwhile, the height of the ink liquid level in the first tank 31 for the A color and the B color reaches a position that is raised above the ink liquid level 61.

In addition, ink in the second path 64 for the A color and the B color runs down to the second tank 32 for the same reason as in the embodiment 1 described above, and air has entered. Meanwhile, the height of the ink liquid level in the second tank 32 for the A color and the B color reaches a position that is raised above the ink liquid level 62 (the ink volume in the tank has increased).

The reason why the ink liquid levels in the first tank 31 and the second tank 32 for the A color and the B color both rise is that the air entering from the line head 2 of the A color and the B color separates the first path 63 and the second path 64, and the ink 40 in the first path 63 and the second path 64 flows separately into the first tank 31 and the second tank 32.

Meanwhile, the ink liquid level in the first tank 31 of the C color and the D color is lowered due to the same effect as described in FIG. 2B. That is, the ink liquid level in the first tank 31 of the C color and the D color is lowered by the influence of the rise of the ink liquid level in the first tank 31 of the A color and the B color. In addition, the ink liquid level in the second tank 32 of the C color and the D color rises as the ink liquid level in the first tank 21 of the C color and the D color is lowered.

Next, referring to FIG. 2D, a change in the state when the meniscus in the line head 2 of three colors (the A color, B color, C color) of the four colors is destroyed due to application of shaking and shock and air is trapped in the ink circulation unit 4 is described.

Also in this case, the third path 65 for all of the A color-D color is filled with the ink 40 as the one-way valve 66 is disposed, in the same manner as before the transportation.

The first path 63 and the second path 64 for the D color are respectively filled with the ink 40. In addition, the height of the ink liquid level of the first tank 31 of the D color is at a position that is lower than the ink liquid level 61 before transportation. Furthermore, the height of the ink liquid level of the second tank 32 of the D color is at a position that is raised above the ink liquid level 62 before transportation.

In the first path 63 of the A color, B color, C color, air enters up to a height near the ink liquid level 62 of the second tank 32, but for the same reason as in the embodiment 1 described above, air does not enter further in the first path 63. Meanwhile, the height of the ink liquid level in the first tank 31 for the A color, B color, C color reaches a position that is raised above the ink liquid level 61.

In addition, ink in the second path 64 for the A color, B color, C color runs down to the second tank 32 for the same reason as in the embodiment 1 described above, and air has entered. Meanwhile, the height of the ink liquid level in the second tank 32 for the A color, B color, C color reaches a position that is raised above the ink liquid level 62 (the ink volume in the tank has increased).

The reason why the ink liquid levels in the first tank 31 and the second tank 32 for the A color, B color, C color both rise is that the air entering from the line head 2 of the A color, B color, C color separates the first path 63 and the second path 64, and the ink 40 in the first path 63 and the second path 64 flows separately into the first tank 31 and the second tank 32.

Meanwhile, the ink liquid level in the first tank 21 of the D color is lowered due to the same effect as described in FIG. 2B. That is, the ink liquid level in the first tank 21 of the D color is lowered by the influence of the rise of the ink liquid level in the first tank 31 of the A color, B color and C color. In addition, the ink liquid level in the second tank 32 of the D color rises as the ink liquid level in the first tank 21 of the D color is lowered.

Next, referring to FIG. 2E, a change in the state when the meniscus in the line head 2 of all the colors (the A color, B color, C color, D color) of the four colors is destroyed due to application of shaking and shock and air is trapped in the ink circulation unit 4 is described.

The operation in this case is equivalent to the detail described in the embodiment 1 above, and air that has entered from the line head 2 of all the colors separates the first path 63 and the second path 64. As a result, the ink liquid levels in the first tank 31 and the second tank 32 has risen for all the colors.

As described above, also in the ink jet printer 1A of the embodiment 2, a part of the first path 63 (in this case, the bent section 63*b*) connecting the first tank 31 through the image recording unit 3 is positioned lower than the ink liquid level 62 in the second tank 32, so the position 63*h* of the ink liquid level in the first path 63 (in the path 63*a*) does not come to the position that is lower than the ink liquid level 62 in the second tank 32 in the perpendicular direction (the gravitational force direction), so the position 63*h* of the ink liquid level in the first path 63 (in the path 63*a*) does not become lower than the ink liquid level 62 in the second tank 32. Therefore, the ink 40 in the first tank 31 does not run down to the second tank 32.

In addition, in the case of the embodiment 2, the first tank shared air chamber 8 and the second tank shared air chamber 9 are provided for a plurality of the ink circulation units 4. That is, a single atmosphere release valve 46 and a single filter 51 can let a plurality of the first tank 31 communicate/isolated with/from the atmosphere simultaneously. In the same manner, a single filter 51 can let a plurality of the second tanks 32 communicate/isolated with/from the atmosphere simultaneously. Thus, the number of components of the ink jet printer 1A is reduced, making it possible to save space and reduce costs. This effect becomes more prominent with increases the number of the ink circulation units.

Meanwhile, it goes without saying that the present invention is not limited to the configurations illustrated in the embodiments described above, and that various alterations can be mad, without departing from the scope or spirit of the present invention.

For example, the shape of the first path 63 is not limited to the approximately-U shape, and any shape may be adopted as long as a part of it is positioned lower than the ink liquid surface 62. In addition, while a so-called line printer has been explained in the present invention, it may also be applied to a so-called serial printer that performs image recording while moving both the recording medium and the ink head.

What is claimed is:

1. An ink jet printer comprising:

an ink circulation unit comprising:

an image recording unit to discharge ink to perform image recording on a recording medium;

a first tank disposed above the image recording unit in a gravitational force direction to supply the ink to the image recording unit through a first ink path;

a second tank disposed below the image recording unit in the gravitational force direction to collect the ink that was not discharged from the image recording unit through a second ink path; and a pump to send the ink from the second tank to the first tank through a third ink path, wherein at least apart of the first ink path connecting the first tank and the image recording unit is positioned below an ink liquid level in the second tank in the gravitational force direction; and wherein no part of the first ink path passes through the second ink tank.

2. The ink jet printer according to claim 1, wherein:

in the second tank, a liquid level detection unit is provided for maintaining a height of the ink liquid level in the second tank in a desired range; and at least a part of the first ink path is positioned below the desired range of the ink liquid level in the second tank maintained by the liquid level detection unit in the gravitational force direction.

3. The ink jet printer according to claim 2, wherein a shape of the first ink path is configured as an approximately-U shape, and a bent section in the approximately-U shape is positioned below the desired range of the ink liquid level in the second tank in the gravitational force direction.

4. The ink jet printer according to claim 2, wherein a space above the liquid level detection unit in the second tank in the gravitational force direction has a capacity such that the space can at least store all of the ink in the second path.

5. The ink jet printer according to claim 1, wherein a shape of the first ink path is configured as an approximately-U shape, and a bent section in the approximately-U shape is positioned below the ink liquid level in the second tank in the gravitational force direction.

6. The ink jet printer according to claim 1, wherein when the ink is circulating in the ink circulation unit, image recording is performed on the recording medium by the image recording unit.

7. The ink jet printer according to claim 6, wherein when the ink is circulating in the ink circulation unit, the first tank is made to communicate with atmosphere, and when the ink is not circulating in the ink circulation unit, the first tank is isolated from atmosphere.

8. The ink jet printer according to claim 1, wherein when the ink is circulating in the ink circulation unit, the first tank and the second tank are made to communicate with atmosphere, and when the ink is not circulating in the ink circulation unit, the first tank is isolated from atmosphere and the second tank is made to communicate with atmosphere.

9. The ink jet printer according to claim 1, wherein the second tank has a capacity such that overflow does not occur even when all of the ink in the second path flows into the second tank.

10. The ink jet printer according to claim 1, wherein:

a plurality of the ink circulation units are provided;

the ink jet printer further comprises a single shared air chamber connected to each first tank of the plurality of ink circulation units and a valve disposed in the shared air chamber to let the shared air chamber communicate with or be isolated from atmosphere; and by releasing the valve, all of the first tanks are made to communicate with or be isolated from atmosphere simultaneously through the shared air chamber.

11. The ink jet printer according to claim 10, wherein the valve is released when the ink is circulating in the plurality of the ink circulation units, and is closed when the ink is not circulating in the plurality of the ink circulation units.

12. The ink jet printer according to claim 11, wherein each second tank of the plurality of the ink circulation units is constantly in communication with atmosphere.

13. The ink jet printer according to claim 10, wherein each second tank of the plurality of the ink circulation units is constantly in communication with atmosphere.

* * * * *